United States Patent [19]

Poulton

[11] Patent Number: 4,921,506

[45] **Date of Patent: * May 1, 1990**

[54] CLAMP ASSEMBLY

[75] Inventor: Richard G. Poulton, Olympia, Wash.

[73] Assignee: David A. Clayton, Bothell, Wash.

[ * ] Notice: The portion of the term of this patent subsequent to Jun. 6, 2006 has been disclaimed.

[21] Appl. No.: 361,589

[22] Filed: Jun. 5, 1989

Related U.S. Application Data

[63] Continuation of Ser. No. 551,088, Nov. 14, 1983, Pat. No. 4,836,389, which is a continuation-in-part of Ser. No. 354,237, Mar. 3, 1982, abandoned.

[51] Int. Cl.[5] ..... B42F 1/00

[52] U.S. Cl. ..... 24/67.1; 24/504

[58] Field of Search ..... 211/45, 46, 48; 24/67 R, 67.1, 67.3, 67.5, 67.7, 502–504, 513, 515, 516, 535–541, 568; 269/196, 236

[56] References Cited

U.S. PATENT DOCUMENTS

| | | |
|---|---|---|
| 694,389 | 3/1902 | Klitsche . |
| 754,194 | 3/1904 | Buchanan . |
| 855,905 | 6/1907 | Rhoads . |
| 1,049,642 | 1/1913 | Baesel . |
| 1,397,930 | 11/1921 | Jefferies . |
| 1,911,277 | 5/1933 | Helmer . |
| 1,951,064 | 3/1934 | Richards et al. . |
| 2,094,544 | 9/1937 | Leja . |
| 2,398,962 | 4/1946 | Randrup . |
| 2,422,865 | 6/1947 | Tucker . |
| 2,650,809 | 9/1953 | Wansink et al. . |
| 2,818,095 | 12/1957 | Stahl et al. . |
| 2,990,961 | 7/1961 | Schneider . |
| 3,069,737 | 12/1962 | Schneider et al. . |
| 3,136,020 | 6/1964 | Baker . |
| 3,159,393 | 12/1964 | Villano . |
| 3,221,892 | 12/1965 | Morcheles et al. . |
| 3,891,093 | 6/1975 | Petrie . |
| 3,896,526 | 7/1975 | Joiner . |
| 4,086,686 | 5/1978 | Takabayashi . |
| 4,836,389 | 6/1989 | Poulton ..... 24/67.1 X |

FOREIGN PATENT DOCUMENTS

| | | |
|---|---|---|
| 799 | of 1895 | United Kingdom . |
| 6829 | of 1911 | United Kingdom . |
| 923974 | 4/1963 | United Kingdom . |

*Primary Examiner*—James R. Brittain

*Attorney, Agent, or Firm*—Delbert J. Barnard

[57] ABSTRACT

A rotary cam member (24) has a peripheral surface disposed about an axis. The peripheral surface includes first, second, and third portions that are, respectively, first, second, and third radial distances ($R_1$, $R_2$, $R_3$) from the axis. $R_1$ is greater than $R_2$ and less than $R_3$. The third portion is positioned circumferentially between the first and second portions. Cam member (24) has an open position in which the second portion contacts the clamp (2, 4) with which lever (22) is being used and a closed position in which the first portion contacts clamp (2, 4). A handle (26) projects from cam member (24) for pivoting cam member (24) back and forth between its open and closed positions. A barrel nut (28) is received in a cylindrical axial hole in cam member (24) and engages pull member (8, 10) that closes clamp (2, 4). Clamp (2, 4) is opened and closed by pivoting cam member (24) into its open and closed positions and rotating it about the longitudinal axis of pull member (8, 10), and thereby pushing and pulling pull member (8, 10). Handle (26) is dimensioned to provide sufficient but not excessive leverage. Lever (22, 22') may be engaged by a conventional support bar (40, 50) to support clamp (2, 4).

1 Claim, 5 Drawing Sheets

CLAMP ASSEMBLY

RELATED APPLICATION

This application is a continuation of applicant's copending application Ser. No. 06/551,088, now U.S. Pat.No. 4,836,389 entitled SELF-LOCKING CAM LEVER, and filed on Nov. 14, 1983, as a continuation in part of applicant's now abandoned application Ser. No. 354,237, filed Mar. 3, 1982, and entitled Self-Locking Cam Lever.

DESCRIPTION

1. Technical Field

This invention relates to mechanisms for activating and releasing pull members that close clamps and, more particularly, to a self-locking cam lever which has a radius that varies circumferentially and which threadedly engages a pull member.

2. Background Art

Clamps of the type used for clamping together several large sheets of paper, such as blueprints, are well-known and are in common use. Clamps of this type are usually closed by the pulling action of a pull member. The conventional method for pulling the pull member into its uppermost position to tighten the clamp and for holding the pull member in that position to keep the clamp closed is illustrated in U.S. Pat. No. 3,069,737, granted Dec. 25, 1962, to A. H. Schneider et al. This method employs a wing nut that engages the upper threaded end of the pull member and tightens against the upper surface of the clamp. This method has several disadvantages. First, since the wing nut is generally made of metal and is tightened against the surface of the clamp, it tends to score and damage that surface. Second, all the pressure of the clamp is on the threads of the pull member and the wing nut, and therefore, the threads tend to become stripped, especially when a wrench is used to tighten the wing nut. This damages both the wing nut and the pull member, and these parts must then be replaced. Third, the wing nut does not permit a quick release of the clamp from its closed to its fully open position. Fourth, it is difficult to judge, when tightening the wing nut, whether the proper degree of tightness of the clamp has been obtained. Fifth, the wing nut is awkward to handle and difficult to tighten sufficiently to fully close the clamp without using a wrench.

British patents Underwood No. 6,829/1911 and Taylor No. 923,974, published Apr. 18, 1963, and the following United States patents each disclose a clamping device that includes a cam member with a peripheral surface eccentrically disposed about an axis:

U.S. Pat. No. 694,389, granted Mar. 4, 1902, to A. Klitsche;

U.S. Pat. No. 1,049,642, granted Jan. 7, 1913, to W. C. Baesel;

U.S. Pat. No. 1,397,930, granted Nov. 22, 1921, to J. L. Jefferies;

U.S. Pat. No. 2,398,962, granted Apr. 23, 1946, to B. F. Randrup;

U.S. Pat. No. 2,422,865, granted June 24, 1947, to J. I. Tucker;

U.S. Pat. No. 2,650,809, granted Sept. 1, 1953, to L. P. Wansink et al;

U.S. Pat. No. 3,136,020, granted June 9, 1964, to C. B. Baker;

U.S. Pat. No. 3,159,393, granted Dec. 1, 1964, to J. Villano; and

U.S. Pat. No. 3,896,526, granted July 29, 1975, to T. R. Joiner.

Taylor, British Patent No. 923,974, discloses a clamp with a cam lever for pulling a pull member to in turn pull one arm of a U-shaped clamp body toward the second arm of such body. The cam lever includes a cam member with a peripheral surface disposed about an axis, said peripheral surface having a plurality of edge portions each of which is a different set perpendicular distance from the axis.

Randrup, U.S. Pat. No. 2,398,962, discloses a clamp in which a cam lever is threadedly connected to the threaded shaft of a T-shaped member. This shaft extends through the members to be clamped together. The cam surface of the lever apparently has a constant radius. The clamp is tightened by rotating the lever about the longitudinal axis of the pull member.

Joiner, U.S. Pat. No. 3,896,526, discloses a friction binder for vertical filing of sheet material that includes a cam lever that is pivotally connected to a pull member.

The above patents and the prior art that is discussed and/or cited therein should be studied for the purpose of putting the present invention into proper perspective relative to the prior art.

DISCLOSURE OF THE INVENTION

A subject of this invention is a self-locking cam lever for use with a clamp of the type used for vertical filing of sheet material and having a top member, two generally vertical clamping members, a pull member, and means for biasing the clamping members away from each other and the clamp into an open position. In this type of clamp, the top member has a horizontal web and an essentially planar vertical flange extending downwardly from each side of this web to form an essentially rectangular downwardly-opening channel. The clamping members are hinged together at their upper ends. The pull member closes the clamp by pulling the clamping members upwardly into the channel and against the flanges to pivot the clamping members into clamping engagement with each other. The pull member includes a threaded shaft that projects upwardly through a hole in the web of the top member. The cam lever activates the pull member.

According to an aspect of the invention, the cam lever comprises a rotary cam member, a handle, and means for engaging the pull member. The cam member has a peripheral surface disposed about a pivot axis. A cylindrical hole extends axially through the cam member and has an axis that coincides with the pivot axis of the cam member and that is perpendicular to the longitudinal axis of the threaded shaft of the pull member. The peripheral surface of the cam member includes a first portion that is a first radial distance from the pivot axis, a second portion that is a second radial distance from the pivot axis, and a third portion that is a third radial distance from the pivot axis. The peripheral surface also includes a flattened area that surrounds and includes such first portion and a rounded area that is adjacent to the flattened area and that includes such third portion. The first radial distance is greater than the second radial distance and less than the third radial distance. The third portion is positioned circumferentially between the first portion and the second portion. The cam member has an open position in which the second portion contacts an upper surface portion of the web of the top member of the clamp and a closed position in which the flattened area contacts this upper surface portion. The handle is used for pivoting the cam member back and forth between its opened and closed positions and for rotating the cam member about the longitudinal axis of the shaft of the pull member. The means for engaging pulls the pull member along the longitudinal axis of its shaft to close the clamp when the cam member is pivoted into its closed position. The means for engaging includes a barrel nut rotatably received in the cylindrical hole in the cam member and threadedly engaging the shaft of the pull member. The handle projects from a portion of the peripheral surface of the cam member substantially circumferentially opposite the third portion of the peripheral surface. The handle is dimensioned to be sufficiently long to provide the leverage required to close the clamp but not long enough to provide excessive leverage that would strip the threaded connection between the shaft and the barrel nut. The cam member comprises a self-lubricating plastic to form a non-abrasive peripheral surface.

A preferred feature of the invention is a handle that, when the cam member is in its closed position, extends outwardly from the peripheral surface of the cam member substantially parallel to and spaced from the upper surface of the web. The handle then angles downwardly and outwardly toward this upper surface and finally extends outwardly substantially parallel to and closely adjacent to the upper surface.

Another subject of the invention is a system for vertically filing sheet material. According to an aspect of the invention, the system comprises a clamp of the type described above, a self-locking cam lever as described above, and support means for supporting the clamp in a horizontal position, such support means including portions that engage the cam lever.

In one embodiment of the invention, the support means comprises a mounting member projecting outwardly from the peripheral surface of the cam member generally opposite the flattened area, and a horizontally extending support bar that is adapted to be attached to a fixed support and that engages the mounting member. The mounting member includes an outer head portion and a reduced diameter neck portion inwardly adjacent to the outer head portion. The support bar includes generally horizontal lip means for slidably engaging the neck portion of the mounting member.

In another embodiment of the invention, when the cam member is in its closed position, a recess is defined adjacent to the flattened area of the peripheral surface by the rounded area of the peripheral surface and an upper surface portion of the web of the top member of the clamp. The support means comprises a horizontally extending support bar that is adapted to be attached to a fixed support, and clip means attached to the upper surface of the web of the top portion of the clamp for securing one end of the support bar against the upper surface of the web. The recess is dimensioned to snugly receive the other end of the support bar to urge this other end against the upper surface of the web.

The cam lever of this invention has numerous advantages, including a number of advantages that relate to the problems discussed above in connection with the common usage of a wing nut. First, since the cam member is made from a self-lubricating plastic, the lever does not score or mar the surface of the clamp. Second, since the handle is dimensioned to provide the correct amount of leverage and eliminates any need to use a wrench, the strain on the threaded members is alleviated and the tendency to strip any threaded portions of such members is diminished. Third, the cam lever can be quickly released simply by rotating it a short distance about the longitudinal axis of the shaft of the pull member and pivoting it from its closed to its open position. Fourth, there is no need to judge whether the clamp is closed sufficiently tightly because the dimensioning of the handle essentially automatically adjusts the tightness. Fifth, the cam lever of this invention provides significantly improved ease of operation.

The flattened area of the peripheral surface of the cam member and the variations in the radial distance between the axis and the peripheral surface help prevent the unintentional opening of the clamp due to unintentional movement of the cam member out of its closed position. Additional protection against unintentional opening of the clamp is provided by the preferred embodiment of the handle, which is closely adjacent to the top of the clamp at its outer end to minimize the chances of something accidentally snagging the handle and pivoting the cam member. The first flattened area also distributes the pressure on the clamp when the cam member is in its closed position, thereby providing added protection against marring the surface of the clamp.

Cam levers constructed according to the invention are inexpensive and easy to make and assemble. Such levers are versatile, easy to install on a clamp, and easy to operate. Levers of the invention are also strong and reliable.

A significant advantage of levers constructed according to the invention is that they may very easily and quickly be installed in a system that includes a readily available and commonly used clamp and readily available and commonly used support means. The compatibility of such cam levers with commonly used support and clamping members further increases the economic advantages of the levers. In addition, the use of such levers with clamps of the type described above helps to prolong the useful life of the clamps by solving the problems previously encountered of marring of the surfaces of the clamps and stripping of the threaded portions of the clamps. In summary, the lever of the invention makes use of clamps easier and more economical without requiring any modification of the simple economical structure of commonly used clamps.

These and other advantages and features will become apparent from the detailed description of the best modes for carrying out the invention that follows.

BRIEF DESCRIPTION OF THE DRAWINGS

In the drawings, like element designations refer to like parts throughout, and.

BEST MODES FOR CARRYING OUT THE INVENTION

Figure 1:
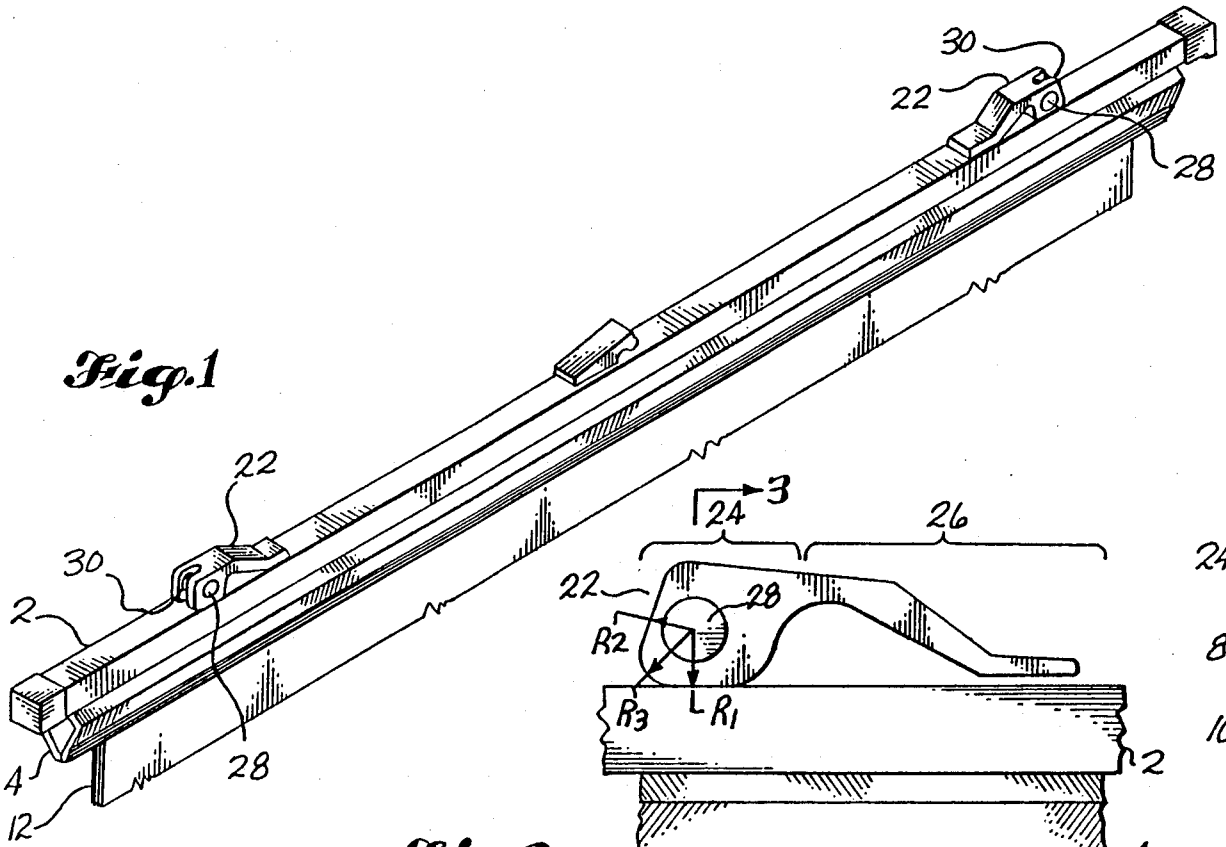
FIG. 1 is a pictorial view of a document clamp equipped with two cam levers of the first preferred embodiment and includes fragments of documents being held by the clamp.

The drawings show two embodiments of a self-locking cam lever 22, 22′ that are constructed according to the invention and that also constitute the best modes of the invention currently known to the applicant. The cam lever 22, 22′ is designed to be used with clamps such as the document clamp 2, 4 shown in the drawings.

The clamp 2, 4, which is shown in the drawings and described herein for the purpose of illustrating one type of clamp in conjunction with which the cam lever of this invention may be used, has two main elongated members. The first such member is a rectangular top piece 2 that is commonly made of metal. Top piece 2 has an upper horizontal web and an essentially planar vertical flange extending downwardly from each side of the web to form an essentially rectangular downwardly-opening channel. The second member is a hinged member 4 that is also commonly made of metal and that has two generally vertical side pieces or clamping members that are hinged together along their upper ends. The lower ends of the two side pieces move toward or away from each other as the clamp is closed or opened. When the clamp 2, 4 is closed, the clamping member 4 has a cross section that is essentially diamond-shaped. The top piece 2 has two holes extending through its upper horizontal web, one located near each end. Similarly, the clamping member 4 has two holes extending through its upper hinged portion, which holes are aligned with the two holes in the top piece 2. When the clamp 2, 4 is assembled, the holes in the top piece 2 and the clamping member 4 are aligned to form two passageways. Each of these passageways receives the longitudinal shaft 8 of a T-shaped pull member 8, 10. In addition, two U-shaped flat springs 6 are positioned inside the clamping member 4. Each of the flat springs 6 has a center hole that is aligned with one of the passageways. The longitudinal shaft 8 of the T-shaped pull member 8, 10 passes through the hole in the flat spring 6, the hole in the upper hinged portion of the clamping member 4, and then the hole in the upper web of the top piece 2. The flat springs 6 serve to urge the side pieces of the clamping member 4 away from each other and the clamp 2, 4 into an open position.

The clamping member 4 is closed by pulling the longitudinal shaft 8 of each pull member 8, 10 up through the holes in the flat spring 6, clamping member 4, and top piece 2. The head 10 of the pull member 8, 10 provides a stop for the pull member 8, 10 and is urged against the transverse center of the inner curve of the flat spring 6 when the pull member 8, 10 is in its uppermost position. In order to provide means for locking the clamp in a closed position by preventing the pull member 8, 10 from moving downward, the longitudinal shaft 8 of the pull member 8, 10 is threaded on its outer end so that it may engage a threaded locking member. As stated above, a previously known method of engaging the pull member 8, 10 and securing it in place is to attach a wing nut to the threaded end of the longitudinal shaft 8 and to tighten the wing nut against the top piece 2 of the clamp 2, 4.

As the pull member 8, 10 is pulled up through the holes in the flat spring 6 and the clamp 2, 4, the head 10 of the pull member 8, 10 engages the inner surface of the upper hinge portion of the clamping member 4. Thus, once the head 10 has so engaged the clamping member 4 and the upward motion of the pull member 8, 10 is continued, the clamping member 4 is drawn by the pull member 8, 10 into the channel formed by the top piece 2. As the clamping member 4 is drawn upward into the top piece 2, the two side pieces of the clamping member 4 are forced against the flanges of the top piece 2. This pivots the side pieces into clamping engagement with each other to close the clamp 2, 4.

Figure 2:
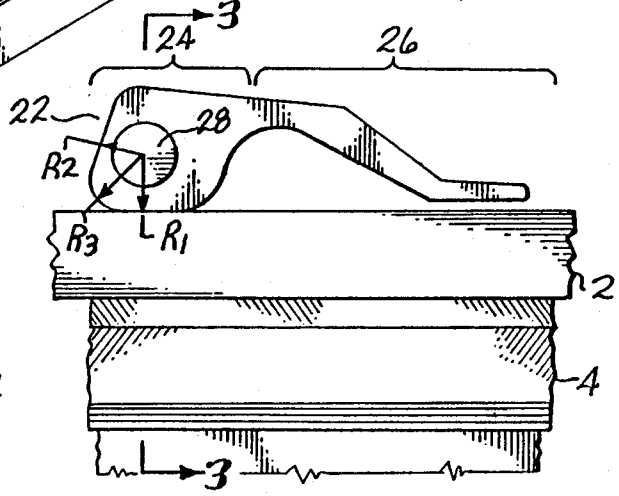
FIG. 2 is an elevational view of a fragment of the document clamp and one of the cam levers shown in FIG. 1 and illustrates the cam lever in its closed position.
Figure 3:
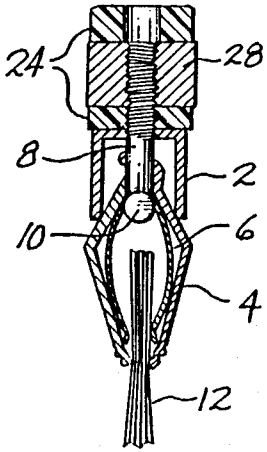
FIG. 3 is a cross-sectional view taken along the line 3—3 in FIG. 2.

Referring to the drawings, the first preferred embodiment of the cam lever 22 comprises a rotary cam member 24, a handle 26 for pivoting and rotating the cam member 24, and a barrel nut 28 for engaging the pull member 8, 10 of the clamp 2, 4. The rotary cam member 24 has a peripheral surface disposed about a transverse pivot axis. This peripheral surface includes a first portion that is a first radial distance ($R_1$ in FIG. 2) from the axis, a second portion that is a second radial distance ($R_2$ in FIG. 2) from the axis, and a third portion that is a third radial distance ($R_3$ in FIG. 2) from the axis. The first radial distance is greater than the second radial distance and less than the third radial distance. The third portion is positioned circumferentially between the first and second portions, and the angle between $R_1$ and $R_2$ is slightly larger than 90 degrees. The cam member 24 has an open position, corresponding to the open position of the clamp 2, 4, in which the second portion contacts the upper surface of the web of the top piece 2 of the clamp 2, 4. The cam member 24 also has a closed position, corresponding to the closed position of the clamp 2, 4, in which the first portion contacts the upper surface of the web. The cam member 24 is pivoted back and forth between its open and closed positions by pivoting the handle 26 about the above-mentioned transverse axis of the cam member 24.

The peripheral surface of the rotary cam member 24 of the preferred embodiment also has first and second flattened areas, which surround and include the above-described first and second portions, respectively. The first flattened area contacts the upper surface of the web of the top piece 2 of the clamp 2, 4 when the cam member 24 is in its closed position, and the second flattened area contacts this surface when the cam member 24 is in its open position. The first and second flattened areas are adjacent to and connected by a rounded area that includes the above-described third portion.

The self-locking cam lever 22 opens and closes the clamp 2, 4 by pulling and pushing the pull member 8, 10. In order to so pull and push the pull member 8, 10, cam levers constructed according to the invention include means for engaging the pull member 8, 10 and for pulling the pull member 8, 10 to close the clamp 2, 4 when the cam member 24 is pivoted into its closed position and pushing the pull member 8, 10 to open the clamp 2, 4 when the cam member 24 is pivoted into its open position.

The preferred way of providing the means for engaging the pull member 8, 10 is to provide the cam lever 22 with a threaded member that threadedly engages a portion of the pull member 8, 10. In the preferred embodiment shown in the drawings, the threaded member is a barrel nut 28, which threadedly engages the outer threaded end of the longitudinal shaft 8 of the pull member 8, 10. The barrel nut 28 is rotatably received in a cylindrical hole in the rotary cam member 24. This cylindrical hole extends axially through the cam member 24 and has an axis that coincides with the transverse axis of the cam member 24 and that is perpendicular to the longitudinal axis of the shaft 8 of the pull member 8, 10. The cam lever 22 pulls and pushes the pull member 8, 10 along said longitudinal axis of the pull member 8, 10.

Figure 8:
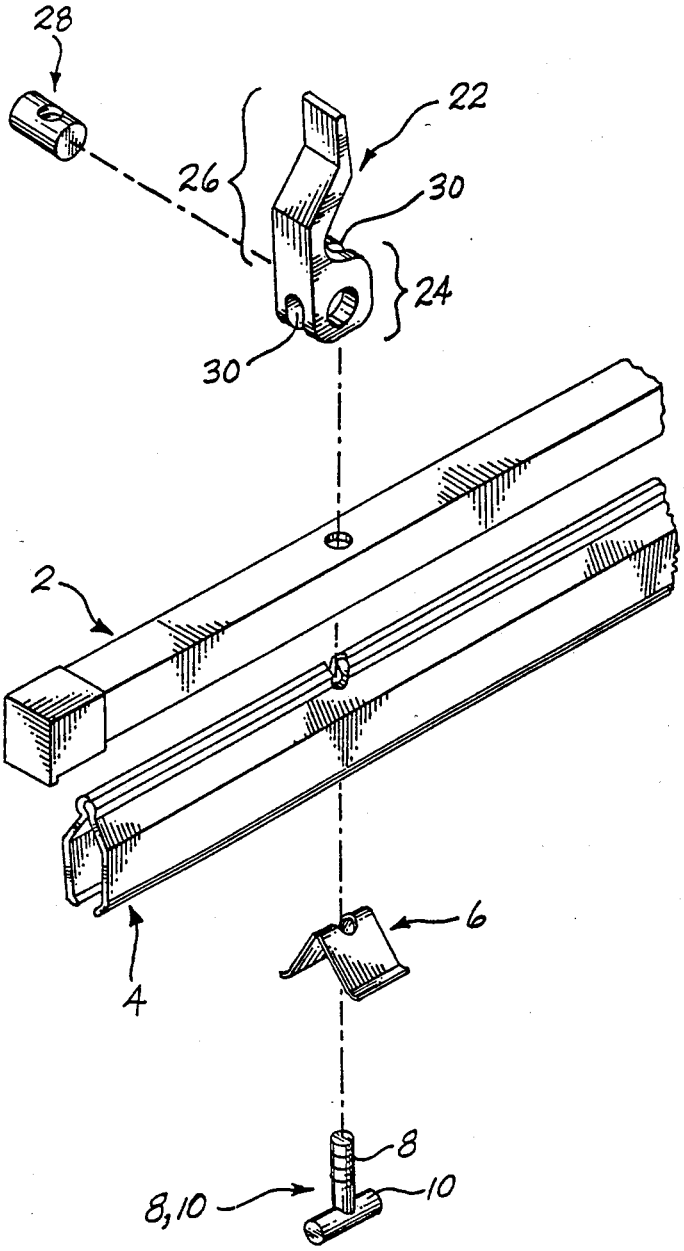
FIG. 8 is an exploded pictorial view of a portion of the document clamp shown in FIG. 1 and the first preferred embodiment of the cam lever.

In order to provide clearance for the longitudinal shaft 8 of the pull member 8, 10 as the rotary cam member 24 is pivoted back and forth between its open and closed positions, the rotary cam member 24 is provided with a groove 30. This groove 30 extends radially from the cylindrical hole which receives the barrel nut 28 to the peripheral surface of the cam member 24 and has a circumferential extent that at least includes the first, second, and third portions of the peripheral surface. As can best be seen in FIG. 8, the groove 30 in the preferred embodiment shown in the drawings has a circumferential extent that includes the first, second, and third portions and the first and second flattened areas of the peripheral surface of the cam member 24, and the ends of the groove 30 extend somewhat beyond the edges of the flattened areas.

The handle 26 projects from a portion of the peripheral surface of the cam member 24 that is substantially circumferentially opposite the third portion of the peripheral surface. The handle 26 projects from the cam member 24 in a direction essentially parallel to the first flattened area of the peripheral surface. The handle 26 then bends twice to that the cam lever 22, when viewed from the side resting on the second flattened area of the peripheral surface of the cam member 24, strongly resembles the number "6" with an upwardly projecting vertical extension on the tip of the tail of the "6". This vertical extension provides an essentially flat surface portion of the handle 26 that is closely adjacent to the upper surface of the web of the top piece 2 of the clamp 2, 4 when the rotary cam member 24 is in its closed position. When the cam member 24 is in its closed position, the handle 26 extends outwardly from the peripheral surface substantially parallel to and spaced from the upper surface of the web, angles downwardly and outwardly toward the upper surface, and then extends outwardly substantially parallel to and closely adjacent to the upper surface. As noted above, this preferred construction of the handle helps prevent accidental opening of the clamp 2, 4.

Although cam levers constructed according to the invention may be manufactured in a variety of ways, the cam lever is preferably made so that the rotary cam member 24 and the handle 26 are a single integral piece. Such a single integral piece can easily and inexpensively be manufactured by molding plastic. The plastic used is preferably of a type that is strong and is self-lubricating to form a non-abrasive surface so that the cam lever 22 will not mar the surface of the clamp 2, 4 when it is operated. An example of a type of plastic with the desired characteristics is the 15% glass reinforced polyester resin manufactured by Celanese Engineering Resins Corporation under the trademark CELANEX 5200.

Figure 4:
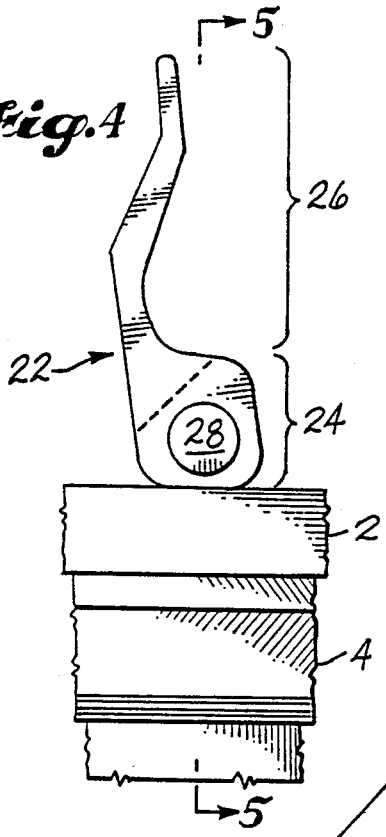
FIG. 4 is like FIG. 2 except that it illustrates the cam lever in its open position.
Figure 5:
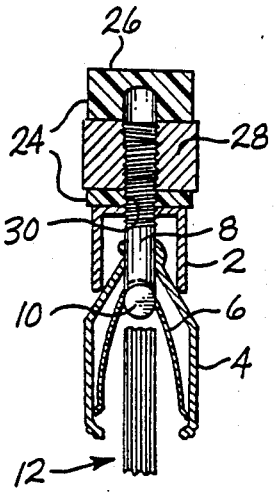
FIG. 5 is a cross-sectional view taken along the line 5—5 in FIG. 4.
Figure 6:
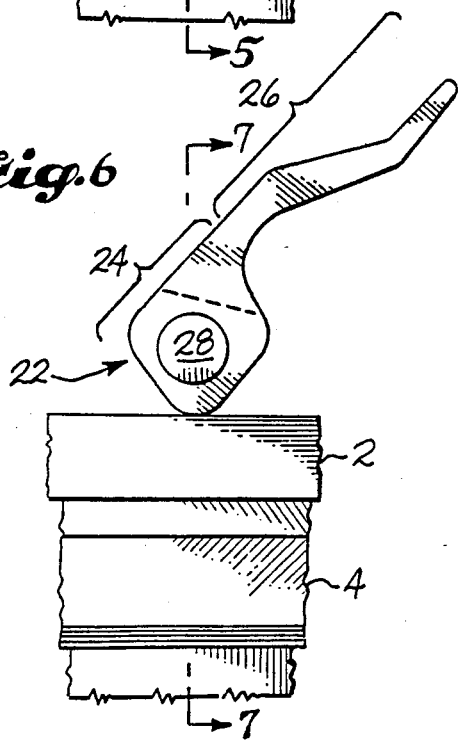
FIG. 6 is like FIG. 2 except that it shows the cam lever in a position intermediate between its open and closed positions.
Figure 7:
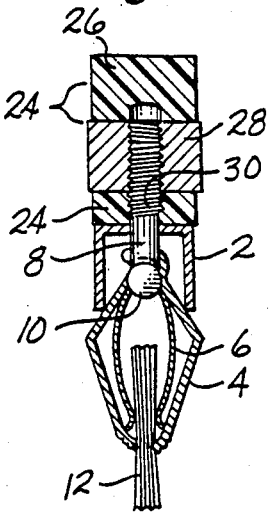
FIG. 7 is a cross-sectional view taken along the line 7—7 in FIG. 6.

When used in conjunction with a clamp, such as the clamp 2, 4 shown in the drawings, cam levers constructed according to the invention operate efficiently and require a minimum amount of effort on the part of the operator. First, with the rotary cam member 24 in its open position (FIGS. 4 and 5), in which the vertical extension of the tail of the "6" points upward, the barrel nut 28 is screwed onto the threaded outer end of the longitudinal shaft 8 of the pull member 8, 10 an amount sufficient to engage the pull member 8, 10 but not sufficient to cause the head 10 of the pull member 8, 10 to exert any significant upwardly directed force on the flat spring 6. Then, the edges of the papers 12 or other material to be held by the clamp 2, 4 are placed between the lower edges of the two side pieces of the clamping member 4. The cam member 24, still in its open position, is rotated about the longitudinal axis of the shaft 8 to draw the pull member 8, 10 in an upward direction to adjust the clamp 2, 4 for the amount of paper to be clamped. This is done by grasping the handle 26 and rotating it in a clockwise direction about such axis. When the lower edges of the two side pieces of the clamping member 4 begin to grip the paper 12, the cam member 24 is rotated back in the opposite direction approximately 180 degrees. Then the clamp 2, 4 is closed by pivoting the cam member 24 about its transverse pivot axis into its closed position. This is easily accomplished by pushing the handle 26 down towards the top piece 2 of the clamp 2, 4. After the cam member 24 is pivoted, the clamp 2, 4 is tightened by rotating the cam member 24 about the longitudinal axis of the shaft 8 and the handle 26 is aligned with the top surface of the clamp 2, 4. This final rotating of the cam member 24 secures the clamp 2, 4 in its closed position by preventing the cam member 24 from being snapped back into its open position without first rotating the cam member 24 to loosen the clamp. To open the clamp 2, 4, the cam member 24 is rotated in a counterclockwise direction and the handle is lifted up to pivot the cam member 24 into its open position and allow the clamp 2, 4 to snap open.

The three different radial distances between the transverse pivot axis of the cam member 24 and its peripheral surface serve to make the cam lever 22 self-locking. Since the third portion of the peripheral surface, which has the greatest radial distance $R_3$ of the three portions, must be moved against the top piece 2 in order to move the cam member 24 from its closed position to its open position, the closed position is a position of equilibrium and the application of an external force is necessary to open the clamp 2, 4. Therefore, the cam lever 22 is not subject to unintended slipping. Since the cam member 24 may be tightened by rotating it when it is in its closed position, the cam member 24 cannot be pivoted into its open position and the clamp 2, 4 remains locked in a closed position until the operator rotates and then pivots the cam lever 22. The flattened areas of the peripheral surface that surround the first and second portions of the peripheral surface serve to enhance the stability of the cam member 24 in either the open or the closed position and help to insure that the operator does not place the cam member 24 in a position that deviates significantly from the intended position.

The positioning of the handle 26 substantially circumferentially opposite the third portion of the peripheral surface, which has the greatest radial distance $R_3$, maximizes the leverage that the handle 26 provides and enhances the ease of operation of the cam lever 22. The bends in the tail of the "6" insure that the handle 26 is essentially parallel to the top piece 2 when the cam member 24 is in its closed position. Hence, the cam lever 22 is neatly tucked out of the way when the clamp 2, 4 is closed.

The handle 26 is dimensioned to provide the proper amount of leverage to operate the clamp 2, 4. The handle 26 is sufficiently long to provide the leverage required to close the clamp but not long enough to provide excessive leverage. Such excessive leverage would allow an operator to exert excessive force on the threaded connection between the shaft 8 nd the barrel nut 28 which could strip the threaded connection.

An aspect of the invention is the use of the self-locking cam lever in a system for vertically filing sheet material which includes a clamp like the clamp 2, 4 shown in the drawings and support means with portions that engage the cam lever. The drawings show two arrangements in which support means of a conventional nature are used in conjunction with the cam lever 22, 22' to support the clamp 2, 4.

Figures 9, 10, 11, 12:
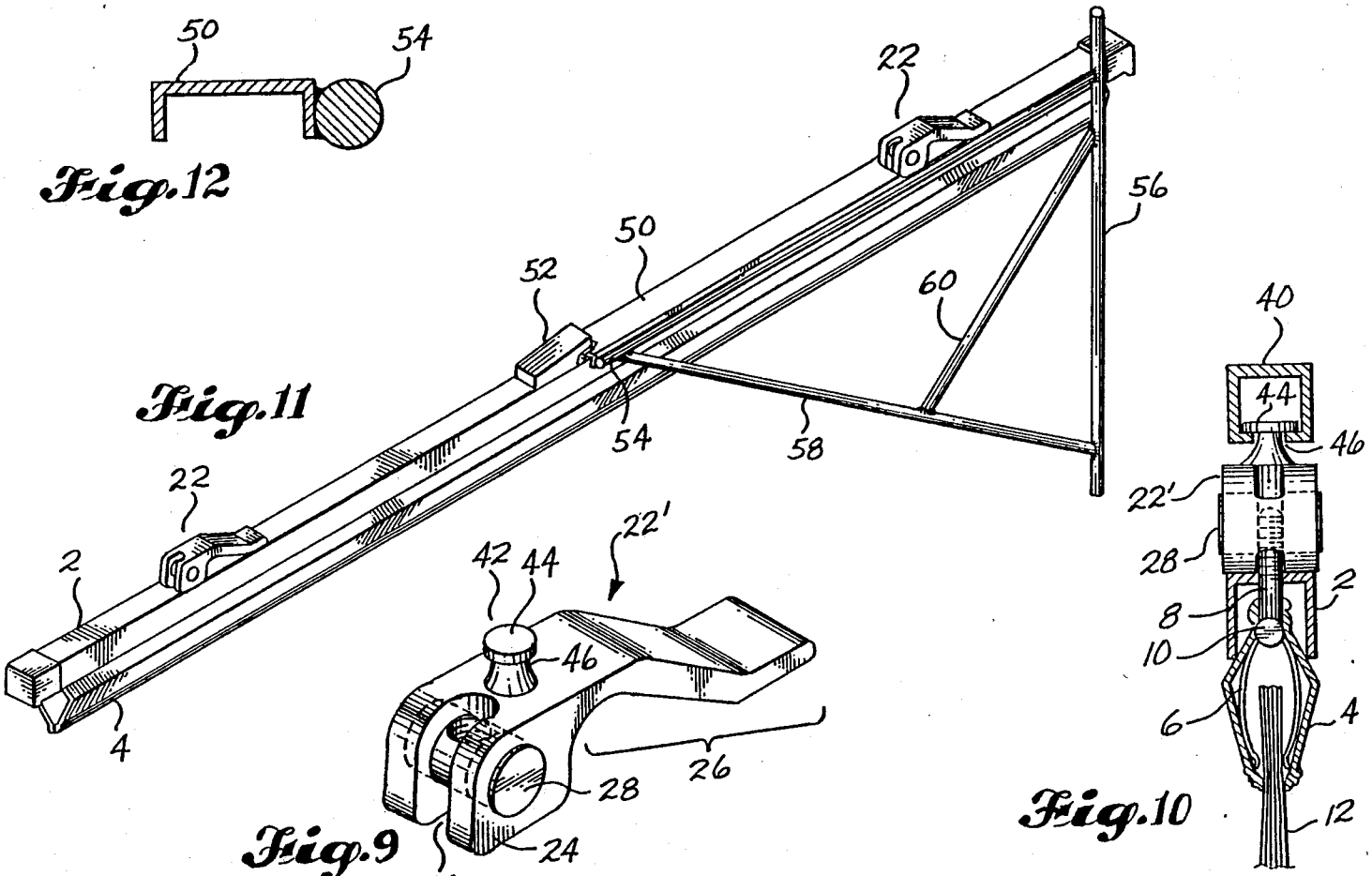
FIG. 9 is a pictorial view of a second preferred embodiment of the cam lever.
FIG. 10 is a vertical sectional view of the lever shown in FIG. 9 installed on the clamp shown in FIG. 1, with a support bar engaging the lever's mounting member to support the clamp.
FIG. 11 is a pictorial view of the lever and clamp shown in FIG. 1, with the clamp being supported by a support device.
FIG. 12 is a cross-sectional view of the support bar shown in FIG. 11.

FIGS. 9 and 10 illustrate a system in which the clamp 2, 4 is supported by the engagement of a second preferred embodiment of the cam lever 22' by a support bar 40. The modified cam lever 22' has a mounting member 42 projecting outwardly from the peripheral surface of the cam member 24 generally opposite the first flattened area. The mounting member 42 extends vertically upwardly when the cam lever 22' is in its closed position. The mounting member 42 includes an outer head 44 and a reduced diameter neck portion 46 inwardly adjacent to the head 44.

The support bar 40 that engages the mounting member 42 extends horizontally and is adapted to be attached to a fixed support. The attachment of the support bar 40 to a fixed support may be accomplished in a number of conventional ways. The support bar 40 is generally rectangular and has a downwardly-opening rectangular channel extending therethrough. The bar 40 has a top horizontal web and a vertical flange extending downwardly from each side of said web. A horizontal lip extends inwardly from the lower end of each of the flanges. An opening to the channel in the support bar 40 is defined by the inner edges of the two horizontal lips. The bar 40 is open at its outer end so that the mounting member 42 may be slid into the channel to allow the horizontal lips to slidably engage the neck 46 of the mounting member 42. The lower surface of the head 44 rests on the inner surfaces of the lips to support the cam lever 22' and the clamp 2, 4 in a horizontal position. FIG. 10 illustrates a clamp 2, 4 and cam lever 22' being supported in this manner.

FIGS. 11–14 illustrate another manner in which the cam lever of the invention may be used in cooperation with support means for supporting the clamp 2, 4 in a horizontal position. In this embodiment of the system of the invention, the first preferred embodiment of the cam lever 22 is engaged by the support means. When the cam member 24 is in its closed position, a recess is defined adjacent to the first flattened area of the peripheral surface. This recess is defined by the rounded area of the peripheral surface and the upper surface of the web of the top piece 2 of the clamp 2, 4.

Figure 13:
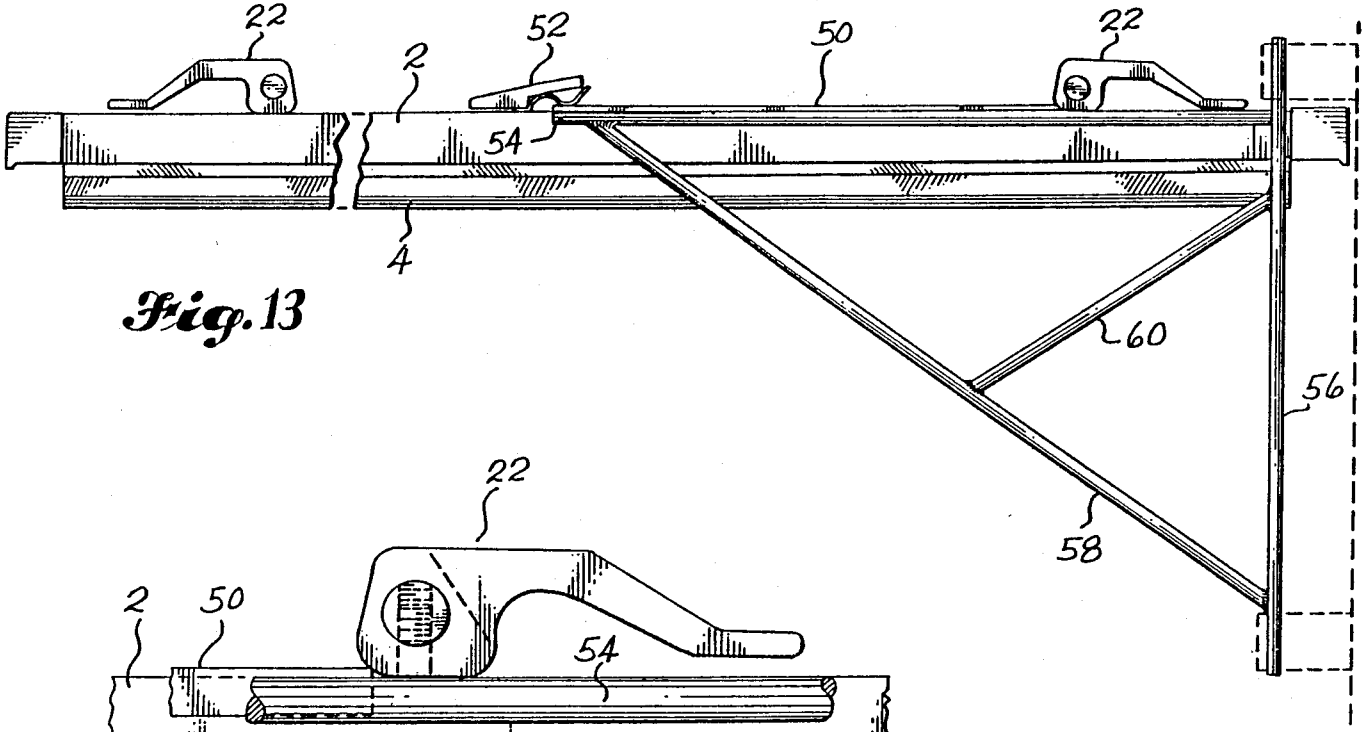
FIG. 13 is an elevational view of the clamp, levers, and support device shown in FIG. 11, with a fixed support shown in phantom.
Figure 14:
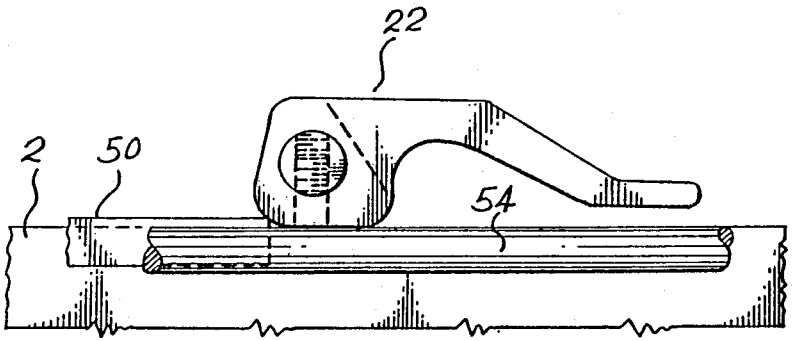
FIG. 14 is an enlarged pictorial view of the area in FIG. 13 where the support bar engages one of the levers.

The support means includes a support bar 50 that has a top web with a vertical flange extending downwardly from each side of the web to form a downwardly-opening rectangular channel. A horizontal rod 54 is secured to the outer surface of the sidewall of one of the flanges of the support bar 50. The inner end of this horizontal rod 54 is attached to a vertical rod 56. Diagonal braces 58, 60 are provided to maintain a right angle between horizontal rod 54 and vertical rod 56. Vertical rod 56 may be attached to a fixed support in a number of known ways. For example, each end of the rod 56 may be received in a suitable opening in a fixed support to pivotably support the clamp 2, 4 in a horizontal position. This arrangement is illustrated in FIG. 13.

The horizontally extending support bar 50 is placed over the top piece 2 of the clamp 2, 4 so that the top piece 2 is received in the downwardly-opening channel formed by the bar 50. One end of the bar 50 is secured to the top piece 2 by a clip 52 that is attached to the upper surface of the top piece 2 at about the middle of the clamp 2, 4. The other end of the support bar 50 is received into the recess formed by the rounded area of the peripheral surface and the upper surface of the top piece 2 and is urged against such rounded area and the top surface of the top piece 2. The recess is dimensioned to snugly receive this other end of the support bar 50 to urge this other end against the top piece 2. The clip 52 is approximately at the center of the clamp 2, 4 but is spaced somewhat inwardly toward the fixed support from the center so that the clip 52 will carry most of the weight being supported.

Throughout the description of the structure and operation of the preferred embodiments of the cam lever of this invention, the terms "up", "down", and the like have been used. These terms have been used for illustrative purposes only, illustrating the usual use attitude of the cam lever and the clamp in conjunction with which it is used. The terms are not intended to indicate that the use attitude of the cam lever is limited to the positions shown in the drawings and described herein, and it is intended to be understood that the cam lever of this invention can be used to advantage in other attitudes.

Although the preferred embodiments of this invention have been illustrated and described, it is to be understood that various modifications may be made without departing from the spirit and scope of the present invention as defined in the following claims.

What is claimed is:

1. A system for vertically filing sheet material, comprising:

a clamp including:

a top member comprising an elongated narrow web, and a pair of elongated narrow flanges integrated therewith and extending downwardly from the opposite sides of the web which with the web form a channel having an essentially U-shaped cross-sectional shape, said web including a pair of longitudinally spaced apart openings and surface regions immediately surrounding said openings, two elongated narrow clamping members each having a first edge and a second edge, said clamping members being hinged together at their first edges, a pair of spaced apart pull members for closing the clamp by pulling the clamping members upwardly into the channel and against the flanges, to pivot the clamping members into clamping engagement with each other, means for biasing the clamping members away from each other and the clamp into an open position, and each said pull member including a threaded shaft that projects upwardly through one of the openings in the web; and a separate cam lever for activating each of the pull members, each said cam lever comprising:

a rotary cam member having a peripheral surface disposed about a pivot axis, and a cylindrical hole extending axially therethrough, said cylindrical hole having an axis that coincides with the pivot axis of the cam member and which is perpendicular to the longitudinal axis of the threaded shaft on the pull member, said peripheral surface including a first portion that is a first radial distance from the pivot axis, a second portion that is a second radial distance from the pivot axis, a third portion that is a third radial distance from the pivot axis, a flattened area that surrounds and includes said first portion, and a rounded area that is adjacent to the flattened area and which includes said third portion, said first radial distance being greater than said second radial distance and less than said third radial distance, and said third portion being positioned circumferentially between said first portion and said second portion, said cam member having an open position in which said second portion contacts the web surface region about its opening in the web, and a closed position in which said flattened area contacts said web surface region, and said cam member comprises a self-lubricated plastic to form a non-abrasive peripheral surface, said non-abrasive peripheral surface contacting said surface region of the web surrounding the opening in the web, a handle for pivoting said cam member back and forth between its open and closed positions and for rotating the cam member about said longitudinal axis, and means for engaging said pull member and for pulling it along said longitudinal axis to close the clamp when said clamp member is pivoted into its closed position, said means for engaging including a barrel nut rotatably received in said cylindrical hole and threadedly engaging said shaft of the pull member, wherein said handle projects from a portion of the peripheral surface of the cam member substantially circumferentially opposite the third portion of said peripheral surface, and said handle is dimensioned to be sufficiently long to provide the leverage required to close the clamp but not long enough to provide excessive leverage that would strip the threaded connection between the shaft and barrel nut during normal hand rotation of the handle and the nut for purposes of effecting final clamping pressure.

* * * * *